US011832693B2

(12) United States Patent
Miller

(10) Patent No.: US 11,832,693 B2
(45) Date of Patent: Dec. 5, 2023

(54) SHOCK-ABSORBING CANE TIP APPARATUS

(71) Applicant: Jornal Kevin Miller, San Bernardino, CA (US)

(72) Inventor: Jornal Kevin Miller, San Bernardino, CA (US)

( * ) Notice: Subject to any disclaimer, the term of this patent is extended or adjusted under 35 U.S.C. 154(b) by 99 days.

(21) Appl. No.: 17/537,944

(22) Filed: Nov. 30, 2021

(65) Prior Publication Data

US 2023/0165344 A1 Jun. 1, 2023

(51) Int. Cl.

| | |
|---|---|
| ***A45B 9/04*** | (2006.01) |
| ***A61H 3/02*** | (2006.01) |
| ***A45B 9/02*** | (2006.01) |

(52) U.S. Cl.

CPC ..... *A45B 9/04* (2013.01); *A45B 9/02* (2013.01); *A61H 3/0277* (2013.01); *A61H 3/0288* (2013.01)

(58) Field of Classification Search

CPC ..... A61H 3/0288; A61H 3/0277

See application file for complete search history.

(56) References Cited

U.S. PATENT DOCUMENTS

| | | | | |
|---|---|---|---|---|
| 2,397,499 | A * | 4/1946 | McGowan | A61H 3/0277 135/82 |
| 2,590,052 | A | 3/1952 | Stuits | |
| 2,675,014 | A * | 4/1954 | Powers | A61H 3/0277 135/82 |
| 2,888,022 | A * | 5/1959 | Fanning | A61H 3/0277 135/82 |
| 4,958,651 | A | 9/1990 | Najm | |
| 4,977,914 | A | 12/1990 | Smerker | |
| 6,374,841 | B1 * | 4/2002 | Yamamoto | A61H 3/0288 135/84 |
| D476,803 | S | 7/2003 | Margolis | |
| 7,025,072 | B2 * | 4/2006 | McGrath | A45B 9/00 135/82 |
| 9,326,572 | B2 | 5/2016 | Daily | |
| 9,681,714 | B1 * | 6/2017 | Yeh | A45B 9/02 |
| 9,737,121 | B2 | 8/2017 | Chen | |
| 9,955,760 | B2 * | 5/2018 | Chen | A61H 3/0277 |
| 11,259,983 | B2 * | 3/2022 | Linge | A61H 3/0288 |

(Continued)

FOREIGN PATENT DOCUMENTS

| | | | |
|---|---|---|---|
| GB | 196117 A | * | 1/1922 |
| GB | 1018529 A | * | 1/1966 |

(Continued)

*Primary Examiner* — David R Dunn
*Assistant Examiner* — Danielle Jackson

(57) ABSTRACT

A shock-absorbing cane tip apparatus for user comfort and improved cane tip longevity includes a tip base having a base top side, a base bottom side, and a base perimeter. A tip sidewall is coupled to the tip base. The tip sidewall has a sidewall outer face, a sidewall inner face, and a sidewall top rim. The sidewall inner face defines a cane cavity to slidingly receive a tip end of a cane. A bottom plate is coupled to the tip base within the cane cavity. A compression spring is coupled to the bottom plate and is oriented perpendicular to the base top side. A top plate is coupled to the compression spring and engages a distal end of the tip end of the cane to compress the compression spring when weight is pushed onto the cane.

9 Claims, 7 Drawing Sheets

(56) References Cited

U.S. PATENT DOCUMENTS

| | | | | |
|---|---|---|---|---|
| 2010/0307549 | A1 | 12/2010 | Goodwin | |
| 2010/0313925 | A1* | 12/2010 | Jiang | A45B 9/04<br>135/82 |
| 2011/0073146 | A1 | 3/2011 | Miller | |

FOREIGN PATENT DOCUMENTS

| | | | | | |
|---|---|---|---|---|---|
| GB | 2318510 | A | * | 4/1998 | A61H 3/0277 |
| GB | 2341313 | A | * | 3/2000 | A45B 9/04 |

* cited by examiner

SHOCK-ABSORBING CANE TIP APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to walking aid devices and more particularly pertains to a new walking aid device for user comfort and improved cane tip longevity. The present invention includes a pair of protective washers and a shock spring. It can be selectively removed from a cane for replacement and repair.

(2) Description of Related Art Including Information Disclosed Under 37 CFR 1.97 and 1.98

The prior art relates to walking aid devices. Known devices often include multiple tip segments to allow for multidirectional flexibility or movement. These devices lack a controlled coaxial shock absorption system within the cane. Other known devices lack a pair of protective washers to prolong longevity of the rubberized tip and to ensure smooth functioning with a variety of cane types.

BRIEF SUMMARY OF THE INVENTION

An embodiment of the disclosure meets the needs presented above by generally comprising a tip base having a base top side, a base bottom side, and a base perimeter. A tip sidewall is coupled to the tip base. The tip sidewall has a sidewall outer face, a sidewall inner face, and a sidewall top rim. The sidewall inner face defines a cane cavity configured to slidingly receive a tip end of a cane. A bottom plate is coupled to the tip base. The bottom plate is coupled within the cane cavity. A compression spring is coupled to the bottom plate. The compression spring is oriented perpendicular to the base top side. A top plate is coupled to the compression spring. The top plate has a top plate diameter less than a cavity diameter of the cane cavity. The top plate is configured to engage a distal end of the tip end of the cane and compress the compression spring when weight is pushed onto the cane.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
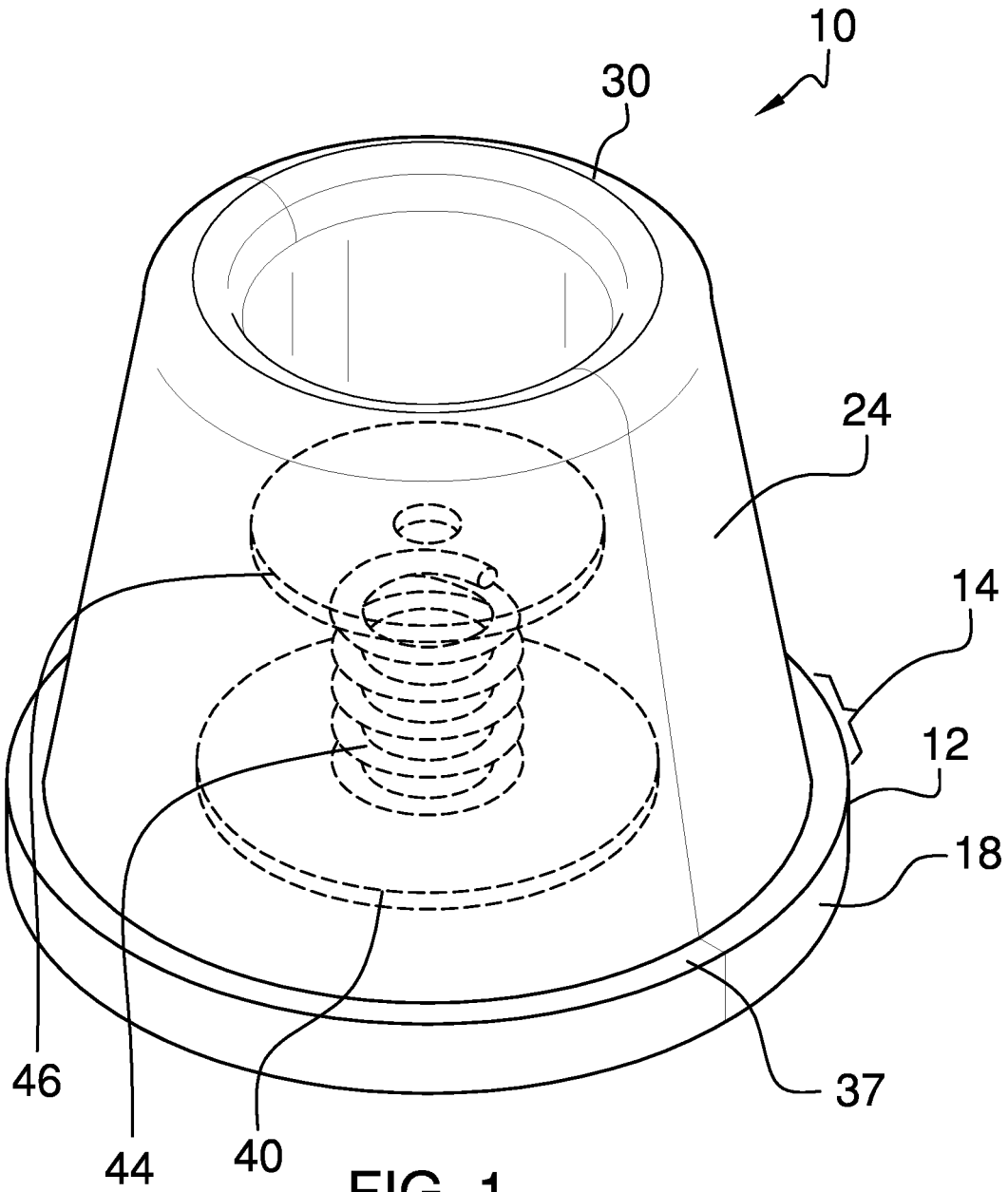
FIG. 1 is an isometric view of a shock-absorbing cane tip apparatus according to an embodiment of the disclosure.
Figure 2:
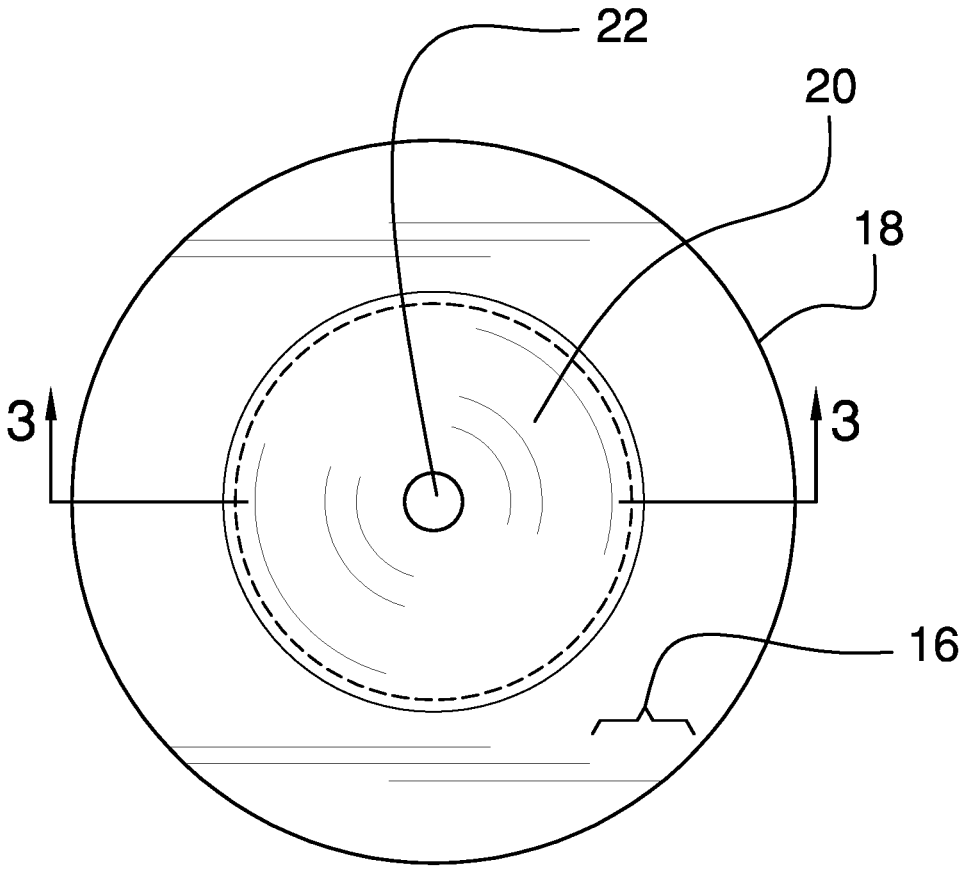
FIG. 2 is a bottom plan view of an embodiment of the disclosure.
Figure 3:
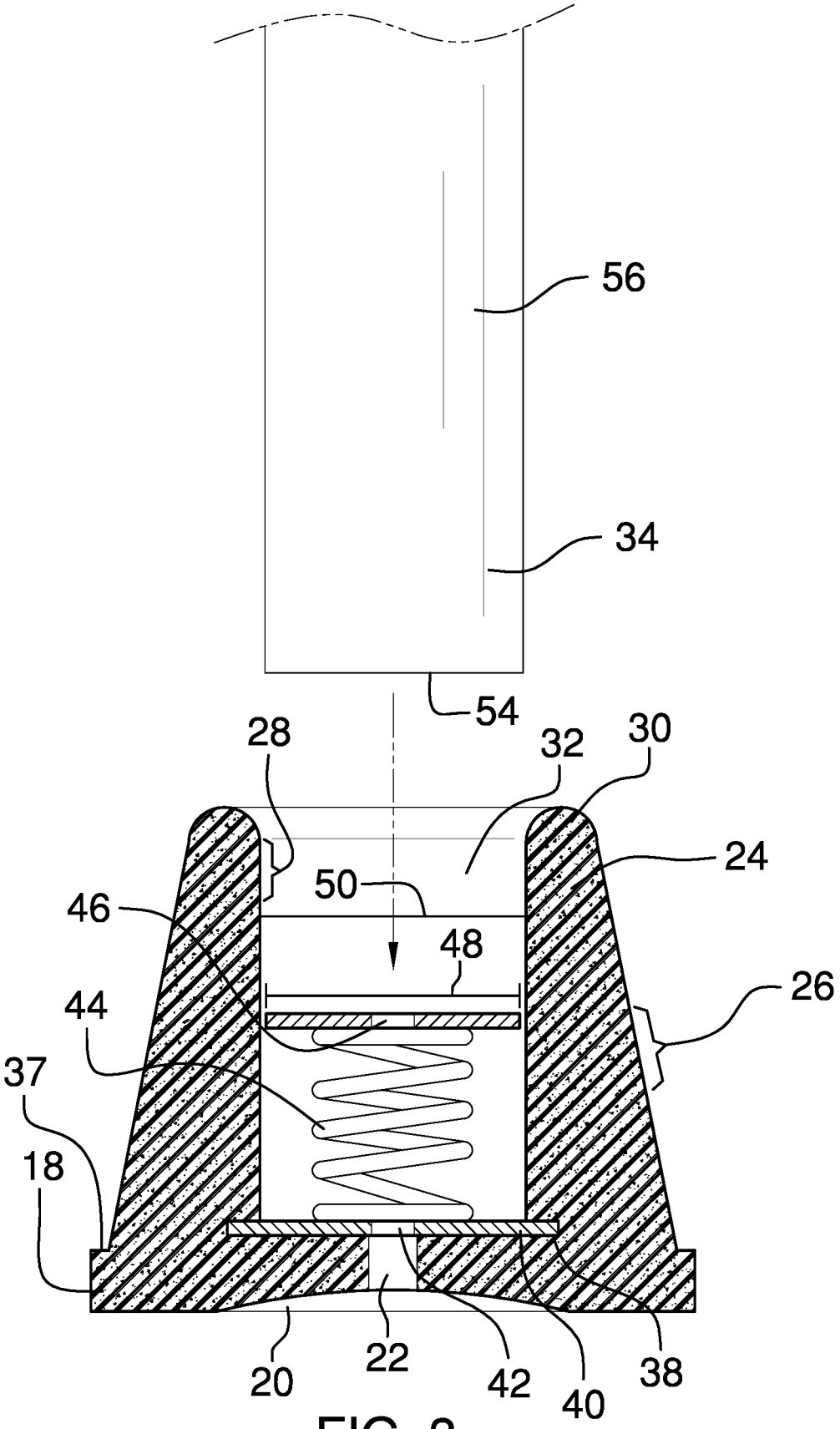
FIG. 3 is a cross-sectional view of an embodiment of the disclosure.
Figure 4:
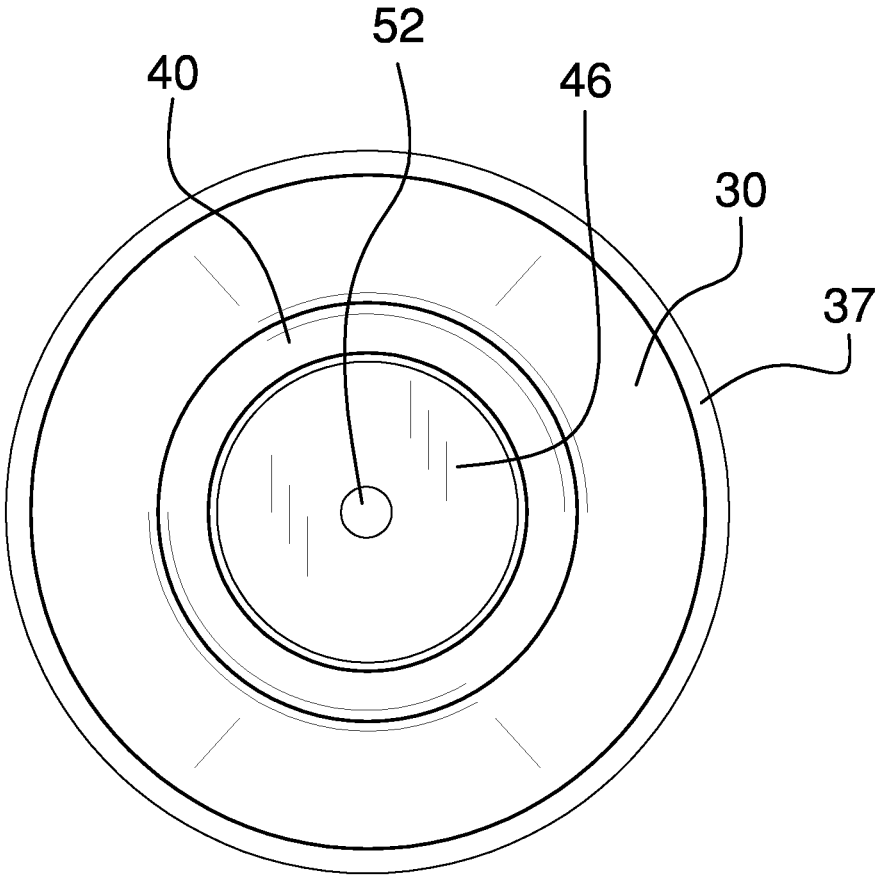
FIG. 4 is a top plan view of an embodiment of the disclosure.
Figure 5:
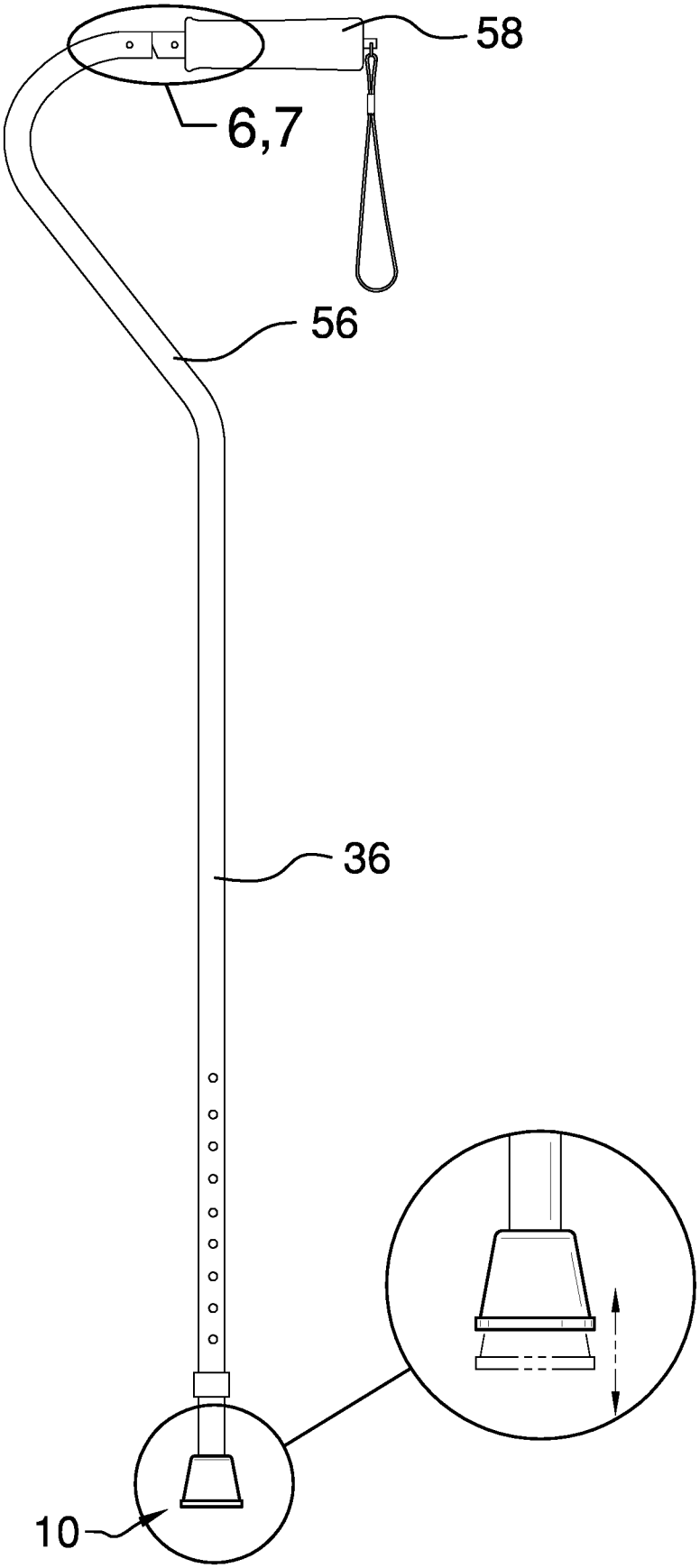
FIG. 5 is an in-use view of an embodiment of the disclosure.

With reference now to the drawings, and in particular to FIGS. 1 through 5 thereof, a new walking aid device embodying the principles and concepts of an embodiment of the disclosure and generally designated by the reference numeral 10 will be described.

As best illustrated in FIGS. 1 through 5, the shock-absorbing cane tip apparatus 10 generally comprises a tip base 12 having a base top side 14, a base bottom side 16, and a base perimeter 18. The base bottom side 16 may have a central rounded cutout portion 20 to improve flexibility and handling of uneven terrain as well as to support directional changes. The tip base 12 has a central base release aperture 22 extending therethrough to release air and prevent suction within the rounded cutout portion 20.

A tip sidewall 24 is coupled to the tip base 12. The tip sidewall 24 has a sidewall outer face 26, a sidewall inner face 28, and a sidewall top rim 30. The sidewall outer face 26 may be tapered and the sidewall inner face 28 may be cylindrical. The sidewall inner face 28 defines a cane cavity 32 configured to slidingly receive a tip end 34 of a cane 36. The sidewall top rim 30 may be rounded to more easily receive the tip 34. The tip sidewall 24 and the base perimeter 18 define an outer lip 37 of the base top side therebetween for improved flexibility of the tip base 12. The sidewall inner face 28 may have a plate slot 38 adjacent the base top side 14. The tip sidewall 24 and the tip base 12 may be of singular construction and may be made of a durable rubberized material such as, but not limited to, thermoplastic rubber, low resilience polyurethane, and the like.

A bottom plate 40 is coupled to the tip base 12. The bottom plate 40 is coupled within the cane cavity 32. The bottom plate 40 is coupled within the plate slot 38. The bottom plate 40 may have a central bottom release aperture 42 extending therethrough and may be circular. The bottom release aperture 42 is coaxially positioned with the base release aperture 22. A compression spring 44 is coupled to the bottom plate 40. The compression spring 44 is oriented perpendicular to the base top side 14. The compression spring 44 may be fixedly coupled to the bottom plate 40 to prevent misalignment.

A top plate 46 is coupled to the compression spring 44. The top plate 46 may have a top plate diameter 48 less than a cavity diameter 50 of the cane cavity to prevent interference during motion. The top plate 46 may have a central top release aperture 52 extending therethrough and coaxially aligned with the bottom release aperture 42. The top plate 46 is configured to engage a distal end 54 of the tip end 34 of the cane and compress the compression spring 44 when weight is pushed onto the cane 36. The top plate 46 may be fixedly coupled to the compression spring 44 to prevent misalignment.

Figure 6:
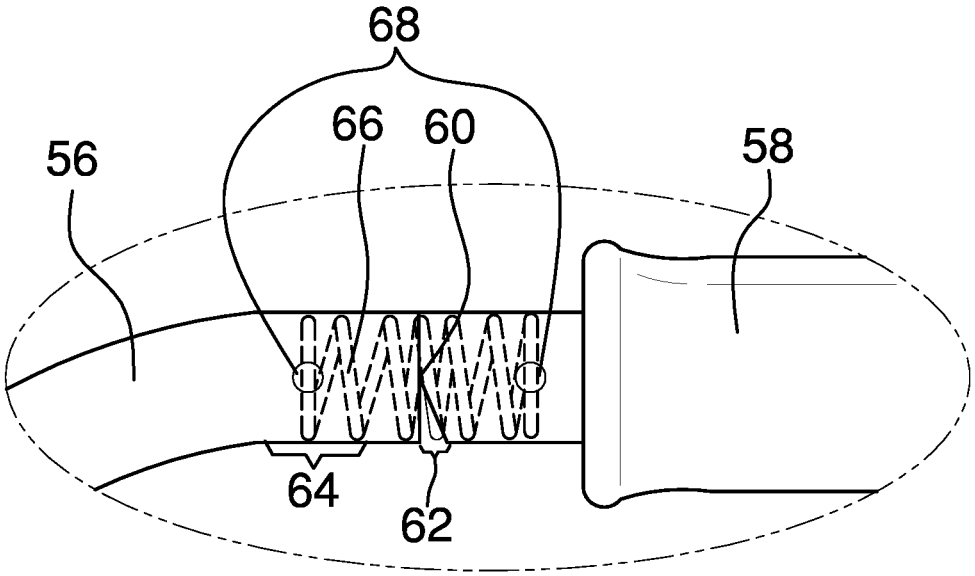
FIG. 6 is a side detailed view of a shaft and handle of an embodiment of the disclosure.
Figure 7:
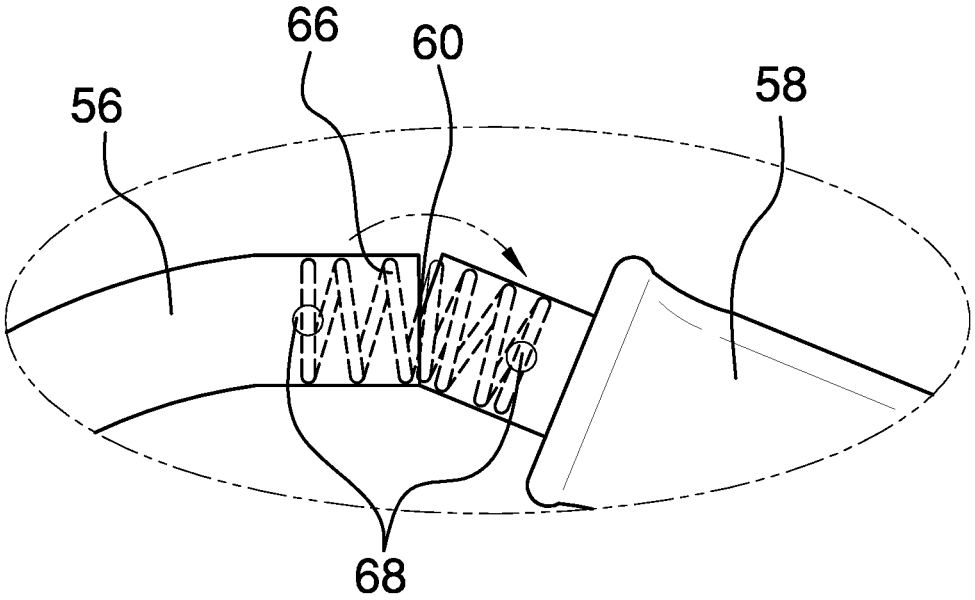
FIG. 7 is a side detailed view of a shaft and handle of an embodiment of the disclosure similar to FIG. 6 but in an alternative position.
Figure 8:
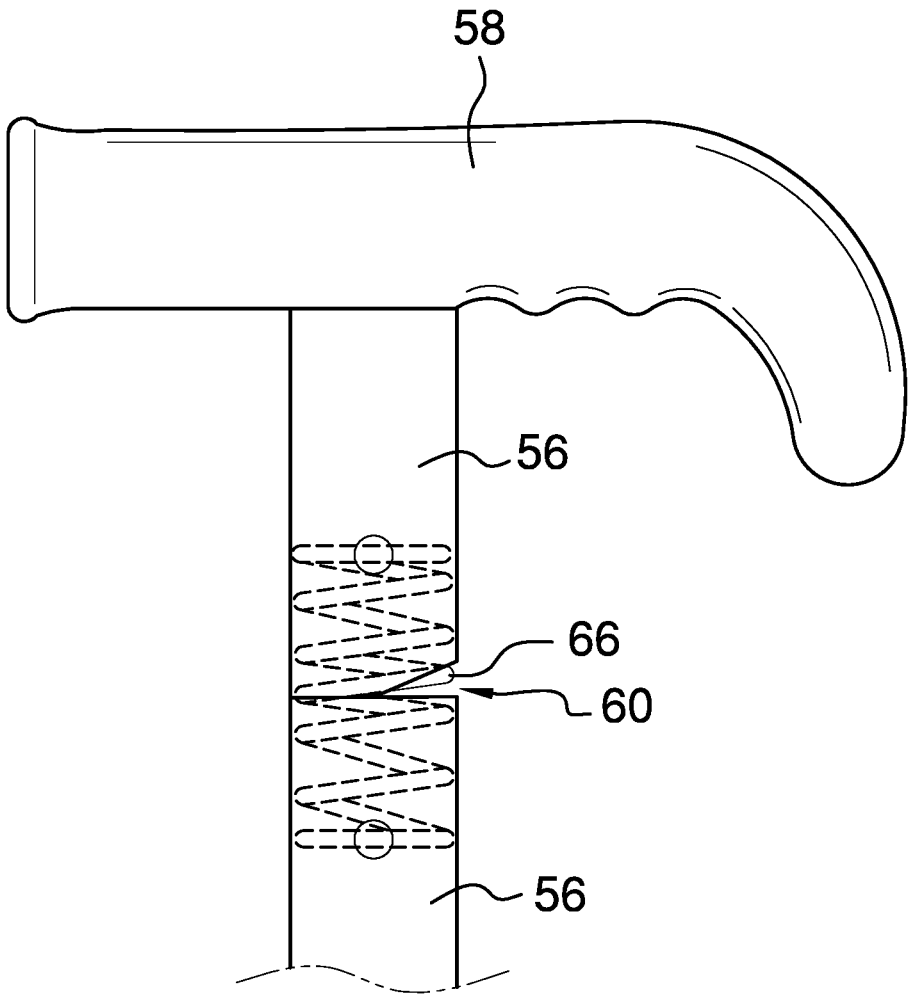
FIG. 8 is a side detailed view of an alternative shaft and handle of an embodiment of the disclosure.

The cane 36 may be included as part of the apparatus 10. The cane 36 includes a shaft 56 terminating in the tip end 34 and a handle 58. The handle 58 may be supported horizontally. The shaft 56 of the cane may be divided proximal the handle 58 with a notch opening 60. The notch opening 60 may have a notch portion 62 oriented towards a shaft underside 64 of the shaft. A handle spring 66 is coupled within the shaft 56 on each side of the notch opening 60 and allows the handle 58 to elastically move between a horizontal position and a bent position as shown in FIGS. 6 and 7. Similarly, as shown in FIG. 8, the handle 58 may be a pistol style grip and the shaft 56 may be straight having a notch opening 60 and handle spring 66 allowing for pivoting of the handle 58 rearwardly relative to the shaft 56. The handle spring 66 may be a coil spring 66 fixed with a pair of rivets 68 or may alternatively be a rubber composite sleeve.

In use, the tip end 34 of the cane is placed into the cane cavity 32 against the top plate 46. The cane cavity 32 is dimensioned to slidingly receive the cane 36 such that it maintains position when lifted off the ground. The top plate 46 and the bottom plate 40 prevent the tip end 34 from damaging the apparatus 10 and eliminating the need for premature replacement.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shock-absorbing cane tip apparatus comprising:

a tip base having a base top side, a base bottom side, and a base perimeter;

a tip sidewall coupled to the tip base, the tip sidewall having a sidewall outer face, a sidewall inner face, and a sidewall top rim, the sidewall inner face defining a cane cavity configured to slidingly receive a tip end of a cane;

a bottom plate coupled to the tip base, the bottom plate being coupled within the cane cavity;

a compression spring coupled to the bottom plate, the compression spring being oriented perpendicular to the base top side;

a top plate coupled to the compression spring, the top plate having a top plate diameter less than a cavity diameter of the cane cavity, the top plate being configured to engage a distal end of the tip end of the cane and compress the compression spring when weight is pushed onto the cane; and the tip sidewall and the base perimeter defining an outer lip of the base top side therebetween.

2. The shock-absorbing cane tip apparatus of claim 1 further comprising the sidewall outer face being tapered and the sidewall inner face being cylindrical.

3. The shock-absorbing cane tip apparatus of claim 1 further comprising the sidewall top rim being rounded.

4. The shock-absorbing cane tip apparatus of claim 1 further comprising the sidewall inner face having a plate slot adjacent the base top side.

5. The shock-absorbing cane tip apparatus of claim 1 further comprising the base bottom side having a central rounded cutout portion.

6. The shock-absorbing cane tip apparatus of claim 1, further comprising:

the base bottom side having a central rounded cutout portion, the tip base having a central base release aperture extending therethrough;

the sidewall outer face being tapered and the sidewall inner face being cylindrical, the sidewall top rim being rounded, the sidewall inner face having a plate slot adjacent the base top side; and the bottom plate having a central bottom release aperture extending therethrough.

7. A shock-absorbing cane tip apparatus comprising:

a tin base having a base top side, a base bottom side, and a base perimeter:

a tip sidewall coupled to the tip base, the tip sidewall having a sidewall outer face, a sidewall inner face, and a sidewall top rim, the sidewall inner face defining a cane cavity configured to slidingly receive a tip end of a cane;

a bottom plate coupled to the tip base, the bottom plate being coupled within the cane cavity;

a compression spring coupled to the bottom plate, the compression spring being oriented perpendicular to the base top side;

a top plate coupled to the compression spring, the top plate having a top plate diameter less than a cavity diameter of the cane cavity, the top plate being configured to engage a distal end of the tip end of the cane and compress the compression spring when weight is pushed onto the cane; and the tip base having a central base release aperture extending therethrough; the bottom plate having a central bottom release aperture extending therethrough; and the top plate having a central top release aperture extending therethrough.

8. A shock-absorbing cane tip apparatus and cane combination comprising:

a cane, the cane having a handle, a shaft, and a tip end;

a tip base having a base top side, a base bottom side, and a base perimeter, the base bottom side having a central rounded cutout portion, the tip base having a central base release aperture extending therethrough;

a tip sidewall coupled to the tip base, the tip sidewall having a sidewall outer face, a sidewall inner face, and a sidewall top rim, the sidewall outer face being tapered and the sidewall inner face being cylindrical, the sidewall inner face defining a cane cavity slidingly receiving the tip end of the cane, the sidewall top rim being rounded, the tip sidewall and the base perimeter defining an outer lip of the base top side therebetween, the sidewall inner face having a plate slot adjacent the base top side;

a bottom plate coupled to the tip base, the bottom plate being coupled within the cane cavity, the bottom plate having a central bottom release aperture extending therethrough;

a compression spring coupled to the bottom plate, the compression spring being oriented perpendicular to the base top side; and a top plate coupled to the compression spring, the top plate having a top plate diameter less than a cavity diameter of the cane cavity, the top plate having a central top release aperture extending therethrough, the top plate engaging a distal end of the tip end of the cane and compressing the compression spring when weight is pushed onto the cane.

9. The shock-absorbing cane tip apparatus of claim 8 further comprising the shaft of the cane being divided proximal the handle and having a notch opening; a handle spring being coupled within the shaft on each side of the notch opening and allowing the handle to elastically move between a horizontal position and a bent position.

* * * * *